US006556177B1

(12) United States Patent
Katayama et al.

(10) Patent No.: US 6,556,177 B1
(45) Date of Patent: Apr. 29, 2003

(54) DRIVER CIRCUIT FOR CAPACITIVE DISPLAY ELEMENTS

(75) Inventors: Osamu Katayama, Nagoya (JP); Takahiro Iwamura, Takahama (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/549,954

(22) Filed: Apr. 14, 2000

(30) Foreign Application Priority Data

Apr. 14, 1999 (JP) ..... 11-106500
Feb. 17, 2000 (JP) ..... 2000-039642

(51) Int. Cl.[7] ..... G09G 3/30
(52) U.S. Cl. ..... 345/76; 345/212; 315/169.3
(58) Field of Search ..... 345/45, 76, 80, 345/52, 98, 211, 212

(56) References Cited

U.S. PATENT DOCUMENTS 4,864,182 A * 9/1989 Fujioka et al. ..... 315/169.3
5,818,406 A * 10/1998 Tsuchi et al. ..... 345/89
5,877,736 A 3/1999 Imajo et al.
6,028,573 A * 2/2000 Orita et al. ..... 345/66
6,256,025 B1 * 7/2001 Imai et al. ..... 345/211

* cited by examiner

*Primary Examiner*—Kent Chang
*Assistant Examiner*—Tom V. Sheng
(74) *Attorney, Agent, or Firm*—Posz & Bethards, PLC

(57) ABSTRACT

A display panel having plural capacitive elements such as electroluminescent elements is driven by an integrated circuit connected between the display panel and a power source. A pair of power transistors such as MOSFETs is connected between the power source and the integrated circuit. The capacitive elements are selectively charged and discharged by operating switching elements in the integrated circuit. The pair of transistors disposed separately from the integrated circuit is turned on or off after the switching elements in the integrated circuit are closed, so that the switching loss only occurs in the transistors outside the integrated circuit, thereby suppressing temperature rise in the integrated circuit. A pair of resistors may be used in place of the transistors to divide a voltage supplied to the capacitive elements between the resistors and the integrated driver circuit. A step-recycle circuit including a condenser for recycling a part of energy stored in the capacitive elements may be further connected between the power source and the pair of transistors, to further reduce power consumption in the integrated circuit.

12 Claims, 11 Drawing Sheets

+150V
+50V
+250V
A
B
C
5
21
22
23
24
25
26
27
28
29
9
10
11
7
8

0V
-100V
-200V
A
B
C
5
21
22
23
24
25
26
27
28
29
9
10
11
7
8

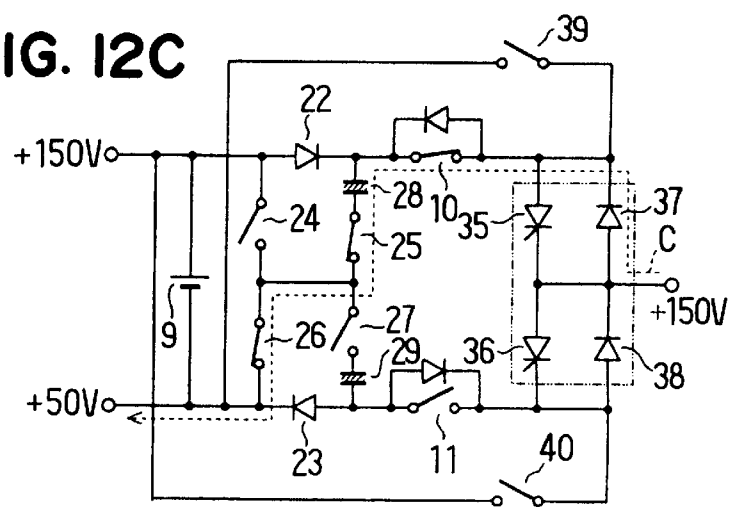
FIG. 12A
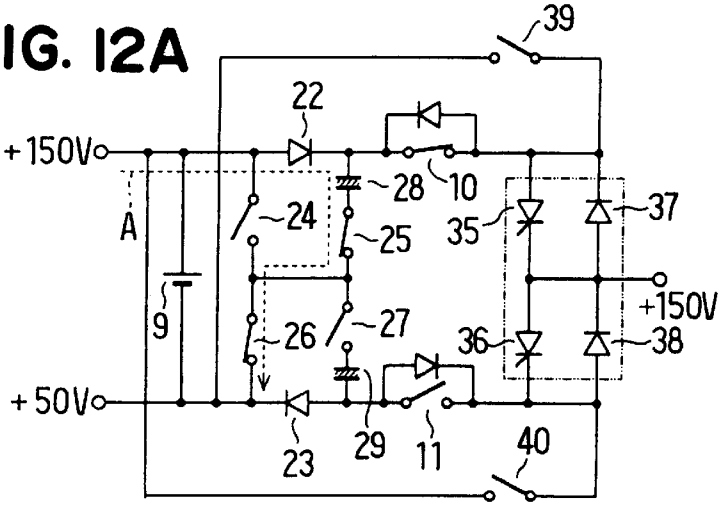
FIG. 12B
FIG. 12C
FIG. 12D

DRIVER CIRCUIT FOR CAPACITIVE DISPLAY ELEMENTS

CROSS-REFERENCE TO RELATED APPLICATIONS

This application is based upon and claims benefit of priority of Japanese Patent Applications No. Hei-11-106500 filed on Apr. 14, 1999 and No. Hei-2000-39642 filed on Feb. 17, 2000, the contents of which are incorporated herein by reference.

BACKGROUND OF THE INVENTION

1. Field of the Invention

The present invention relates to a driver circuit for driving a display panel that includes plural capacitive elements such as electroluminescent elements, optical characteristics of which change according to voltages imposed thereon.

2. Description of Related Art

An electroluminescent display panel (referred to as an EL display panel) that includes a number of capacitive electroluminescent elements (referred to as EL elements) is driven by selectively charging and discharging the EL elements. A relatively large current flows in a scanning electrode driving circuit that supplies scanning voltages to scanning electrodes in such an EL panel, and a relatively large amount of power is consumed mainly as a switching loss in the scanning electrode driving circuit. Therefore, there has been a possibility that the scanning electrode driving circuit malfunctions due to heat generated by power loss.

SUMMARY OF THE INVENTION

The present invention has been made in view of the above-mentioned problem, and an object of the present invention is to provide an improved driver circuit which consumes less power and operates always stably.

A display panel having plural capacitive display elements is driven by supplying a driving voltage through a driver circuit. The driving circuit includes an integrated circuit having plural output circuits, each connected to each scanning electrode corresponding to the capacitive display elements aligned along the scanning electrode, and voltage dividing loads. The voltage dividing loads such as power transistors or resistors are connected between the power source and the integrated circuit. Each output circuit in the integrated circuit is composed of a first switching element for charging the capacitive display element and a second switching element for discharging the same, both constituting a push-pull circuit. LDMOS transistors or SCRs are used as the switching elements.

The voltage between the power source and the display panel is divided between the voltage dividing loads and the integrated circuit, and accordingly power consumption is also allocated to the voltage dividing load and the integrated circuit. Therefore, temperature rise in the integrated circuit is suppressed, and malfunction of the integrated circuit due to the temperature rise therein is avoided. When resistors are used as the voltage dividing loads, the power consumption in the circuit is allocated to the resistors and the integrated circuit according to respective impedance thereof.

When the power transistors such as MOSFETs are used as the voltage dividing loads, they are closed or opened after the switching elements in the integrated circuit are closed. Therefore, switching loss occurs only in the power transistors, avoiding switching loss in the integrated circuit. In this manner, the temperature rise in the integrated circuit is further suppressed, and the integrated circuit stably operates without being affected by the temperature rise.

Preferably, a step-recycle circuit including a condenser is connected between the power source and the power transistors. The level of the driving voltage supplied to the capacitive display elements is changed stepwise by charging and discharging the condenser. The power for driving the capacitive display elements are saved in this manner. At the same time, the condenser is used as a power recycling element. A portion of the energy charged in the capacitive display element is returned to the condenser in the step-recycle circuit and is used again to charge the element in the next cycle. The driving energy is further saved by recycling the energy in the capacitive display element.

Preferably, the display panel is driven with positive and negative voltages alternatively supplied thereto. In this case, a first and a second condenser are disposed in the step-recycle circuit. The first condenser functions to generate the stepwise changing driving voltage and to recycle the energy in the capacitive display element when the panel is driven with the positive voltage. The second condenser performs the same functions when the panel is driven with the negative voltage.

According to the present invention, the amount of power consumed in the integrated circuit is reduced, and thereby malfunctions of the integrated circuit due to temperature rise are avoided.

Other objects and features of the present invention will become more readily apparent from a better understanding of the preferred embodiments described below with reference to the following drawings.

BRIEF DESCRIPTION OF THE DRAWINGS

FIGS. 12A–12D are circuit diagrams showing operation of the fifth embodiment in a positive field.

DETAILED DESCRIPTION OF THE PREFERRED EMBODIMENTS

Figure 1:
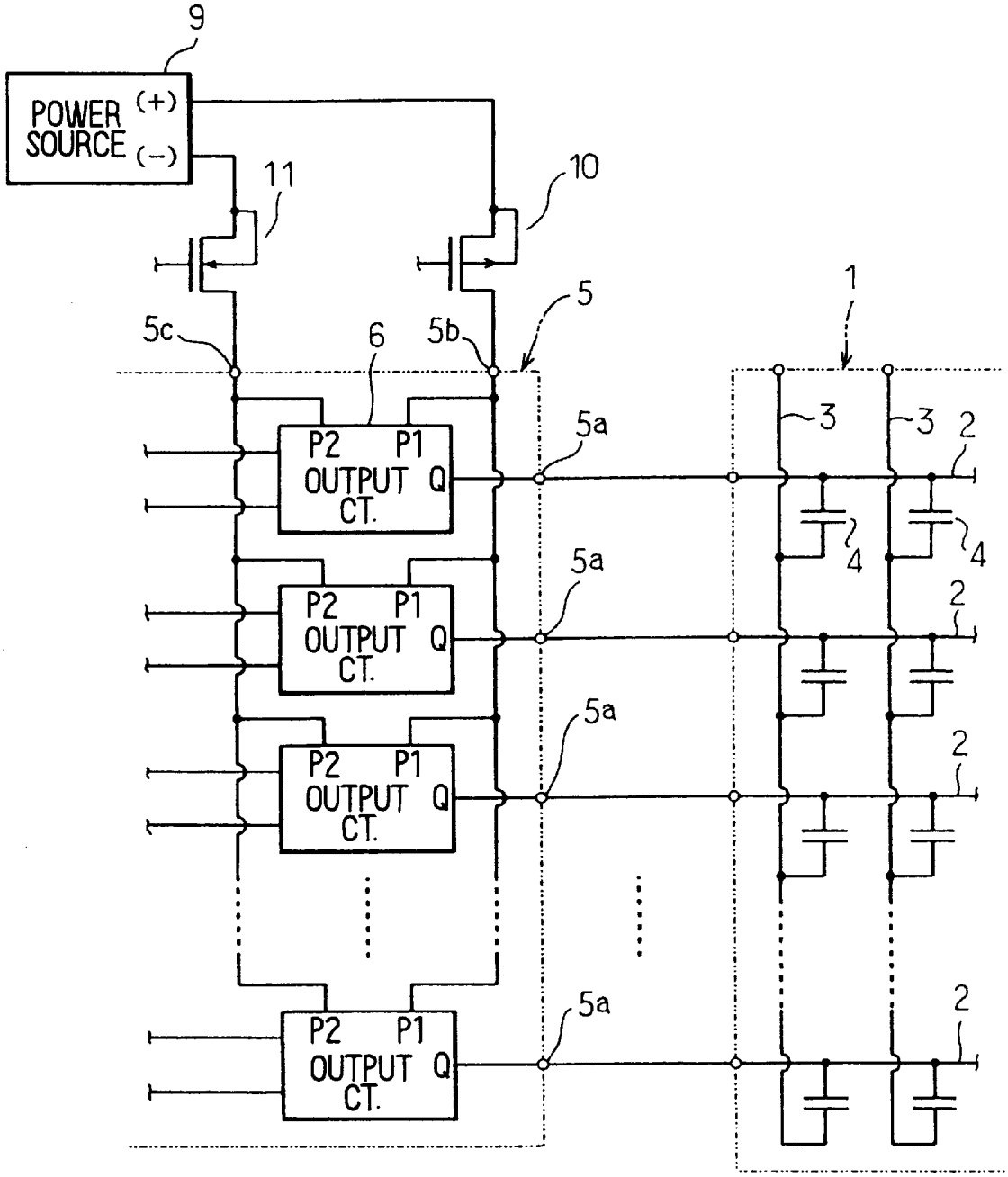
FIG. 1 is a block diagram showing an electroluminescent display panel and a driver circuit thereof as a first embodiment of the present invention.
Figure 2:
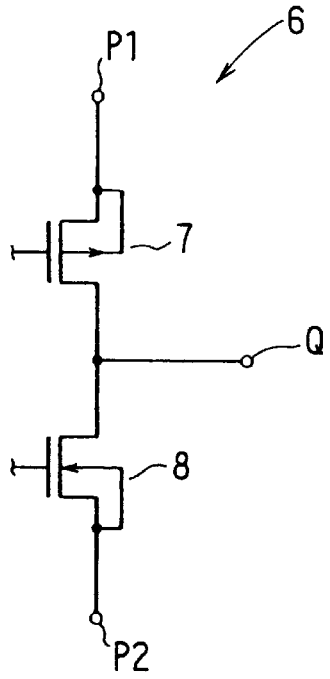
FIG. 2 is a circuit diagram showing switching elements in an output circuit of the driver circuit shown in FIG. 1.

A first embodiment of the present invention will be described with reference to FIGS. 1 and 2. First, referring to FIG. 1, a whole structure of an EL display device will be described. The EL display panel 1 includes plural scanning electrodes 2 running in the row direction, plural data electrodes running in the column direction and an electroluminescent layer interposed between both the scanning and data electrodes. Capacitive EL elements (pixels) 4 are formed at each intersection of the both scanning and data electrodes together with the EL layer. The EL elements are driven by supplying scanning voltages to the scanning electrodes 2 and data voltages to the data electrodes 3. The scanning voltages are supplied from a scanning electrode driving circuit 5 that is an integrated circuit and referred to as a driver IC 5, and the data voltages are supplied from a data electrode driving circuit (not shown).

The driver IC 5 includes plural output circuits 6, each corresponding to each scanning electrode 2. As shown in FIG. 2, each output circuit 6 includes a P-channel LDMOS 7 (a first switching element) and an N-channel LDMOS 8 (a second switching element), both connected in series. A junction of the LDMOS 7 and the LDMOS 8 is connected to an output terminal Q, a first terminal P1 of the series circuit is connected to a first power supply terminal 5*b* of the driver IC 5, and a second terminal P2 is connected to a second power supply terminal 5*c*. The output terminal Q is connected to an output terminal 5*a* of the driver IC 5. The output terminal 5*a* is further connected to the scanning electrode 2.

A power source 9 having a relatively high voltage, e.g., 250 V, is connected to the driver IC 5 through a pair of power MOSFETs 10 and 11. Namely, a plus terminal of the power source 9 is connected to the first power supply terminal 5*b* through a P-channel MOSFET 10, and a minus terminal of the power source 9 is connected to the second power supply terminal 5*c* through an N-channel MOSFET 11. The power MOSFET 10 is controlled so that it turns on after the LDMOS 7 in the output circuit 6 is turned on, while the power MOSFET 8 is controlled so that it turns on after the LDMOS 8 in the output circuit 6 is turned on.

The driver IC 5 also includes a control circuit that selectively turns on or off either one of the LDMOSs 7, 8 according to signals fed from an outside circuit. Both power MOSFETS 10, 11 are controlled by the same controller, or may be controlled by a separate controller.

To charge the EL element 4, the LDMOS 7 is first turned on and then the power MOSFET 10 is turned on. The charging current flows from the plus terminal of the power source 9 to EL element 4 through the power MOSFET 10 and the LDMOS 7 and the scanning electrode 2. On the other hand, to discharge the EL element 4, the LDMOS 8 is first turned on and then the power MOSFET 11 is turned on. The discharging current flows from the EL element 4 to the minus terminal of the power source 9 through the scanning electrode 2, the LDMOS 8 and the power MOSFET 11.

The energy for charging and discharging the EL elements is proportional to $CV^2$, irrespective of resistance in the charging and discharging circuit, where C is a total capacitance of all the EL elements and V is an imposed voltage. On the other hand, switching and conduction losses occur in the charging and discharging circuit. Since the power MOSFETs 10 and 11 are turned on or off after the LDMOSs 7 and 8 in the driver IC 5 are closed, the switching loss only occurs in the power MOSFETs 10 and 11 located outside the driver IC 5. Only a small amount of conduction loss occurs in the LDMOSs 7 and 8 due to on-resistances thereof. Therefore, a temperature rise in the driver IC 5 is suppressed at a low level, and malfunctions of the driver IC 5 due to the temperature rise are avoided. Accordingly, the driver IC 5 can be stably operated. Since the output circuit 6 in the driver IC 5 is a push-pull circuit composed of the LDMOSs 7 and 8, its voltage endurance is high. Moreover, power consumption in the output circuit 6 is suppressed at a low level, because LDMOSs are driven with a small gate current. Further, since the power MOSFETs 10 and 11 are discrete elements disposed separately from the driver IC 5, the heat generated by the switching loss is easily dissipated.

Figure 3:
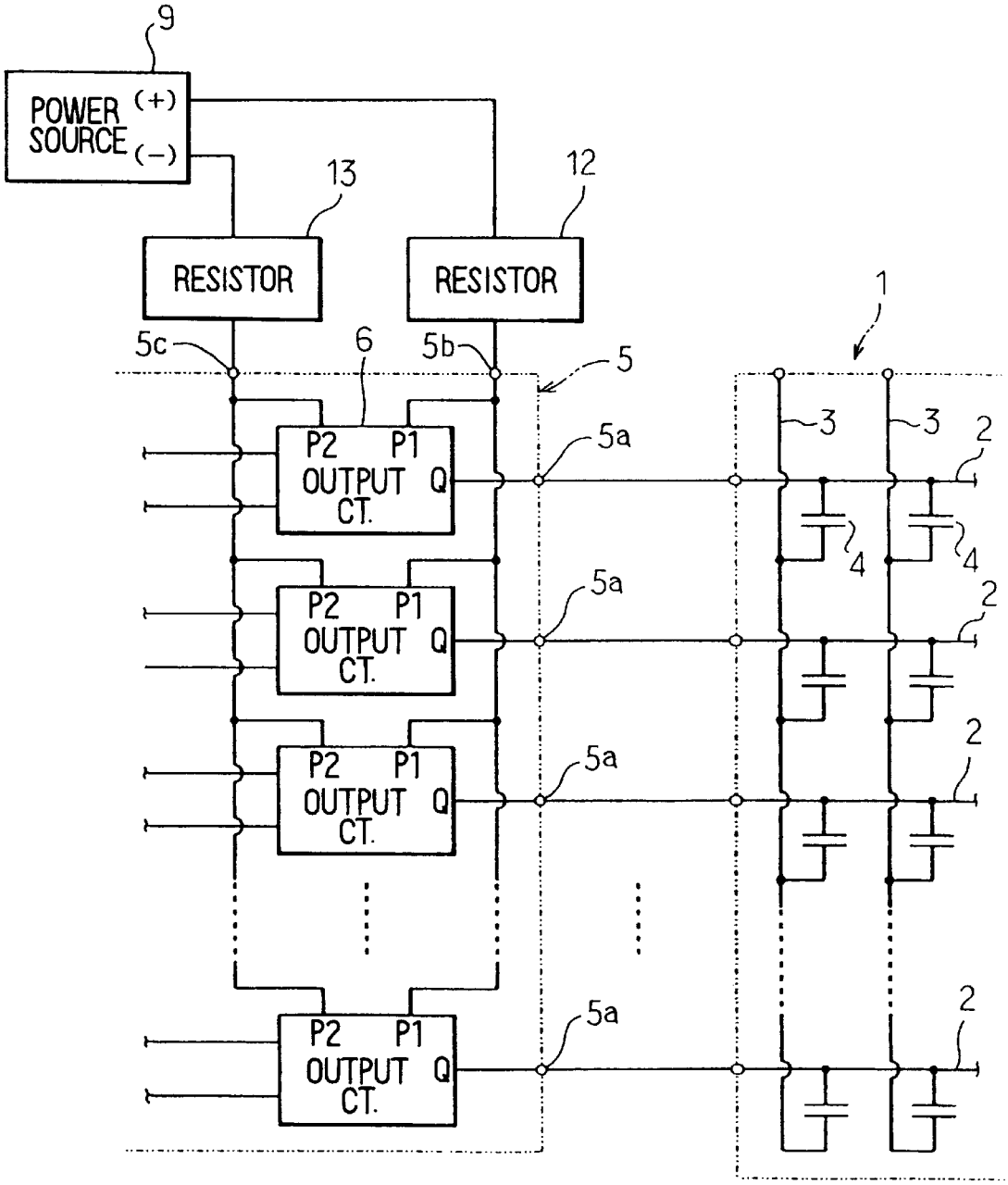
FIG. 3 is a block diagram showing an electroluminescent display panel and a driver circuit thereof as a second embodiment of the present invention.

A second embodiment of the present invention is shown in FIG. 3. In this embodiment, the power MOSFETs 10 and 11 used in the first embodiment are replaced with resistors 12 and 13. More particularly, the resistor 12 is connected between the plus terminal of the power source 9 and the first power supply terminal 5*b* of the driver IC 5, thereby forming a series charging circuit including the resistor 12 and the LDMOS 7. The resistor 13 is connected between the minus terminal of the power source 9 and the second power supply terminal 5*c* of the driver IC 5, thereby forming a series discharging circuit including the resistor 13 and the LDMOS 8.

In charging operation, the voltage between the EL element and the plus terminal of the power source 9 is divided by the resistor 12 and the LDMOS 7. Accordingly, power consumption in the charging circuit is proportionally distributed to the resistor 12 and the LDMOS 7 according to respective impedances thereof. Similarly, in discharging operation, the power consumption in the discharging circuit is proportionally distributed to the resistor 13 and the LDMOS 8 according to respective impedances thereof. In other words, both in the charging and discharging operations, power consumption in the driver IC 5 can be made small relative to total power consumption in the charging and discharging circuits. Therefore, the temperature rise in the driver IC 5 is suppressed, and the operation of the driver IC 5 is stabilized, only by using two outside resistors 12 and 13.

Figure 4:
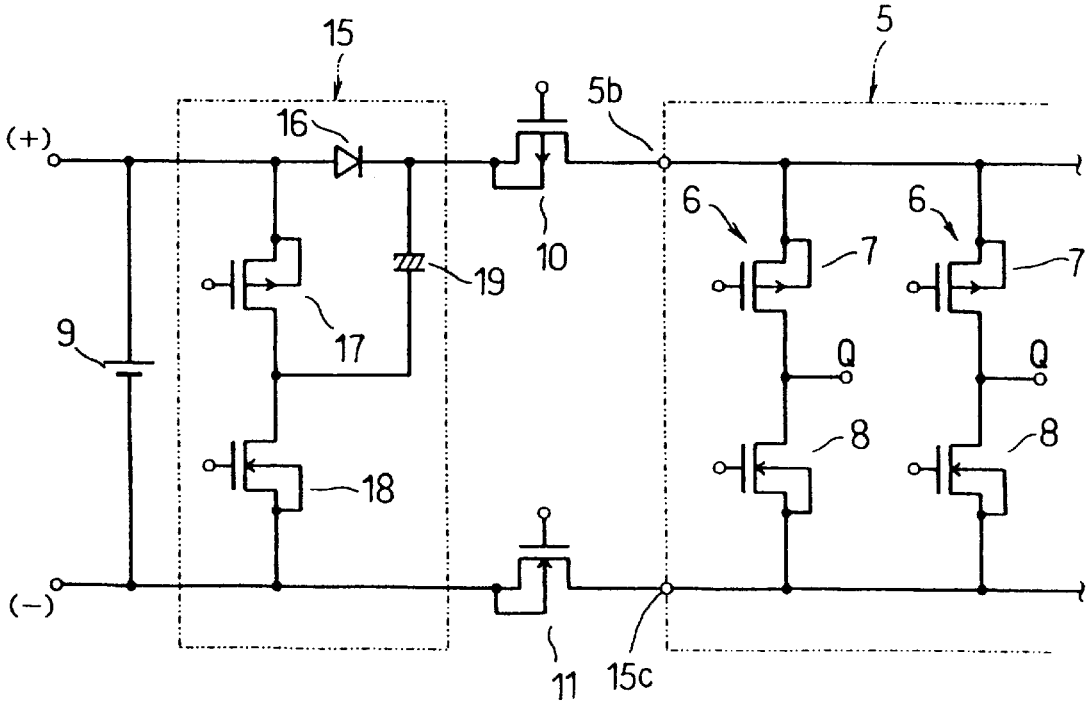
FIG. 4 is a circuit diagram showing a main portion of a driver circuit as a third embodiment of the present invention.
Figure 5A:
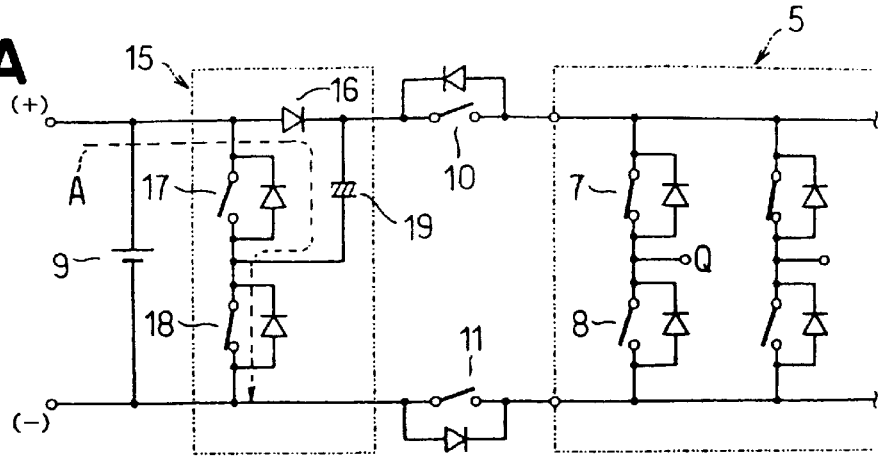
FIGS. 5A–5D are circuit diagrams showing operation of the driver circuit shown in FIG. 4.
Figure 5B:
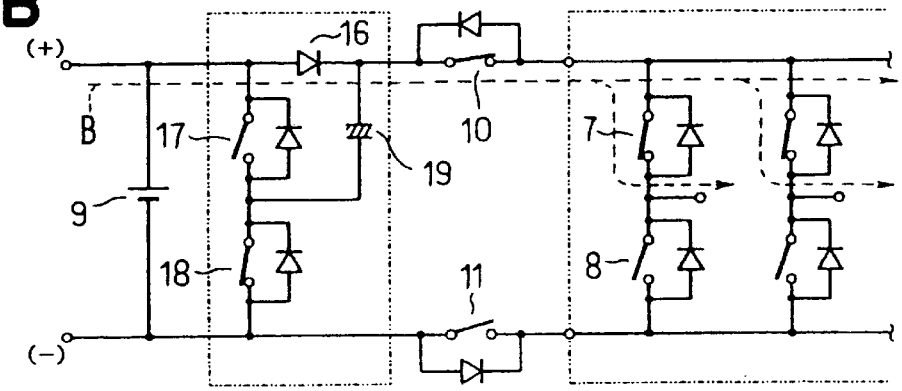
Figure 5C:
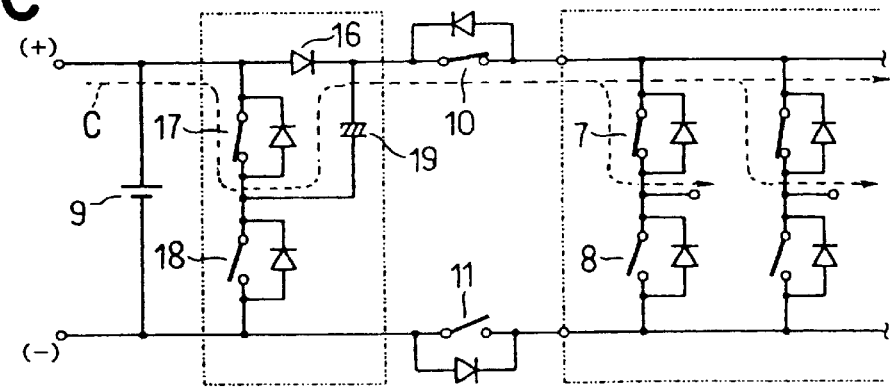
Figure 5D:
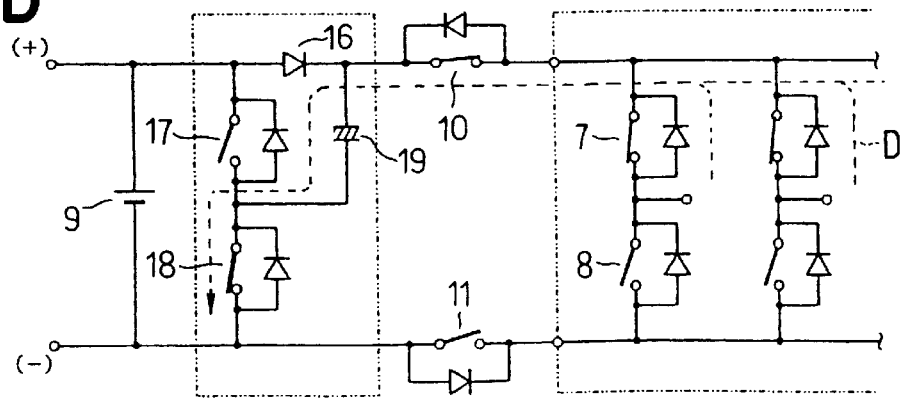

Referring to FIGS. 4–5D, a third embodiment of the present invention will be described. In this embodiment, the level of voltage imposed on the EL element 4 is changed stepwise, and the charging energy is recycled. For this purpose, a step-recycle circuit 15 is added between the power source 9 and the power MOSFETs 10, 11, compared with the first embodiment shown in FIG. 1.

As shown in FIG. 4, the step-recycle circuit 15 is composed of a diode 16, a P-channel MOSFET 17 (a second auxiliary switching element), an N-channel MOSFET 18 (a first auxiliary switching element) and a condenser 19. More particularly, the diode 16 is connected between the plus terminal of the power source 9 and the power MOSFET 10 in the forward direction. A series circuit consisting of the P-channel MOSFET 17 and the N-channel MOSFET 18 is connected between the anode of the diode 16 and the minus terminal of the power source 9. The condenser 19 is connected between the cathode of the diode 16 and a junction of both MOSFETs 17, 18. The MOSFET 18 is controlled so that it turns on during a predetermined period including a starting period of the charging operation of the EL element 4. During the predetermined period in which the MOSFET 18 is turned on, two circuits for charging the condenser 19 are formed. One is a circuit including the plus terminal of the power source 9, the diode 16, the condenser 19 and the MOSFET 18. The other is a circuit including the EL element 4, a parasitic diode (not shown in FIG. 4, connected in parallel to the LDMOS 7 in the reverse direction), the power MOSFET 10, the condenser 19 and the MOSFET 18. On the other hand, the MOSFET 17 is controlled so that it turns on for a predetermined period after the MOSFET 18 is turned off. During the period in which the MOSFET 17 is turned on, to charges on the condenser 19 is superimposed on the voltage of the power source 9.

Referring to FIGS. 5A–5D, operation of the third embodiment will be described. In FIGS. 5A–5D, the LDMOSs 7, 8, the power MOSFETs 10, 11, and the MOSFETs 17, 18 are all shown as switches, and parasitic diodes associated with those transistors are all shown. FIG. 5A shows a stage where the LDMOS 7 in the driver IC 5 and the MOSFET 18 are turned on while other switches are turned off. At this stage, a circuit charging the condenser 19 is formed through a dotted line "A" that includes the diode 16, the condenser 19 and MOSFET 18, and thereby the condenser 19 is charged. Then, the power MOSFET 10 is turned on, as shown in FIG. 5B, the EL element 4 is charged with the power source voltage through a charging circuit shown with a dotted line "B" that includes the plus terminal of the power source 9, the diode 16, the power MOSFET 10 and LDMOS 7.

Then, the MOSFET 17 is turned on, and the MOSFET 18 is turned off at the same time, thereby forming a circuit shown with a dotted line "C" that includes the plus terminal of the power source 9, the MOSFET 17, the condenser 19, the power MOSFET 10, the LDMOS 7 and the EL element 4. At this stage, the EL element 4 is charged with a composite voltage composed of the power source voltage and the voltage of condenser 19 which is superimposed on the power source voltage. The level of the composite voltage is about two times the power source voltage. This means that the EL element 4 is stepwise charged, i.e., first with the power source voltage and then with the composite voltage.

Then, as shown in FIG. 5D, the MOSFET 17 is turned off and the MOSFET 18 is turned on at the same time, thereby forming a circuit charging the condenser 19 with energy stored in the EL element 4 through a dotted line "D" that includes the EL element 4, the parasitic diode of the LDMOS 7, the power MOSFET 10, the condenser 19 and the MOSFET 18. Thus, a portion of energy supplied to the EL element 4 is recycled again to the condenser 19.

As described above, the voltage for charging the EL element 4 is stepwise increased, and thereby less power is consumed in the driver IC 5 and the temperature rise in the driver IC is suppressed. Since the switching loss occurs only in the power MOSFETs 10 and 11, the temperature rise is suppressed in the same manner as in the first embodiment. Moreover, since a portion of the energy supplied to the EL element is recycled to the condenser 19 and is used again for charging the EL element, the power consumption is further saved. Though the voltage for charging the EL element is increased with two steps in the third embodiment described above, it may be increased with more than two steps.

In reference to FIGS. 6–10B, a fourth embodiment of the present invention will be described. In this to embodiment, positive scanning voltages are supplied to the scanning electrodes 2 in a positive field, and negative scanning voltages in a negative field. Both fields are alternated every time the EL display panel is scanned from its top to the bottom. The voltage levels for charging the EL element 4 are stepwise changed, and a portion of the energy supplied to the EL element 4 is recycled and reused in a similar manner as in the third embodiment.

Figure 7:
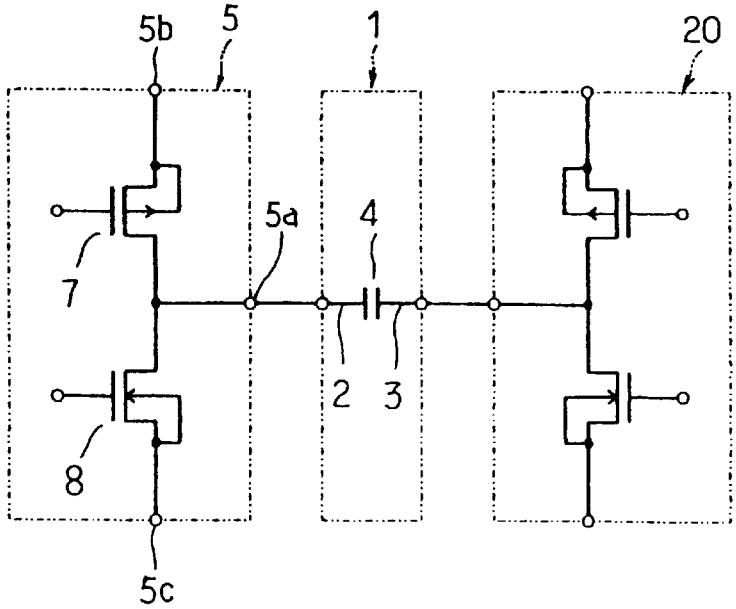
FIG. 7 is a conceptual circuit diagram showing a whole structure of an electroluminescent panel and drivers thereof.

A conceptual structure of the display device according to this embodiment is shown in FIG. 7. The scanning voltages are supplied to the scanning electrodes 2 from the driver IC 5 (a scanning electrode driving circuit), and the data voltages are supplied to the data electrodes 3 from a data electrode driving circuit 20 having a structure similar to that of the driver IC 5. A positive scanning voltage of, e.g., +250 V is supplied to the scanning electrodes 2 in the positive field, and a negative scanning voltage of, e.g., −200 V in the negative field. In synchronism with the scanning voltages, data voltages of, e.g., 0 V and +50 V are selectively supplied to the data electrodes 3. As a result, the EL elements 4 on which +250 V is imposed are activated to emit light in the positive field, while the EL elements 4 on which −250 V is imposed are activated to emit light in the negative field.

Figure 6:
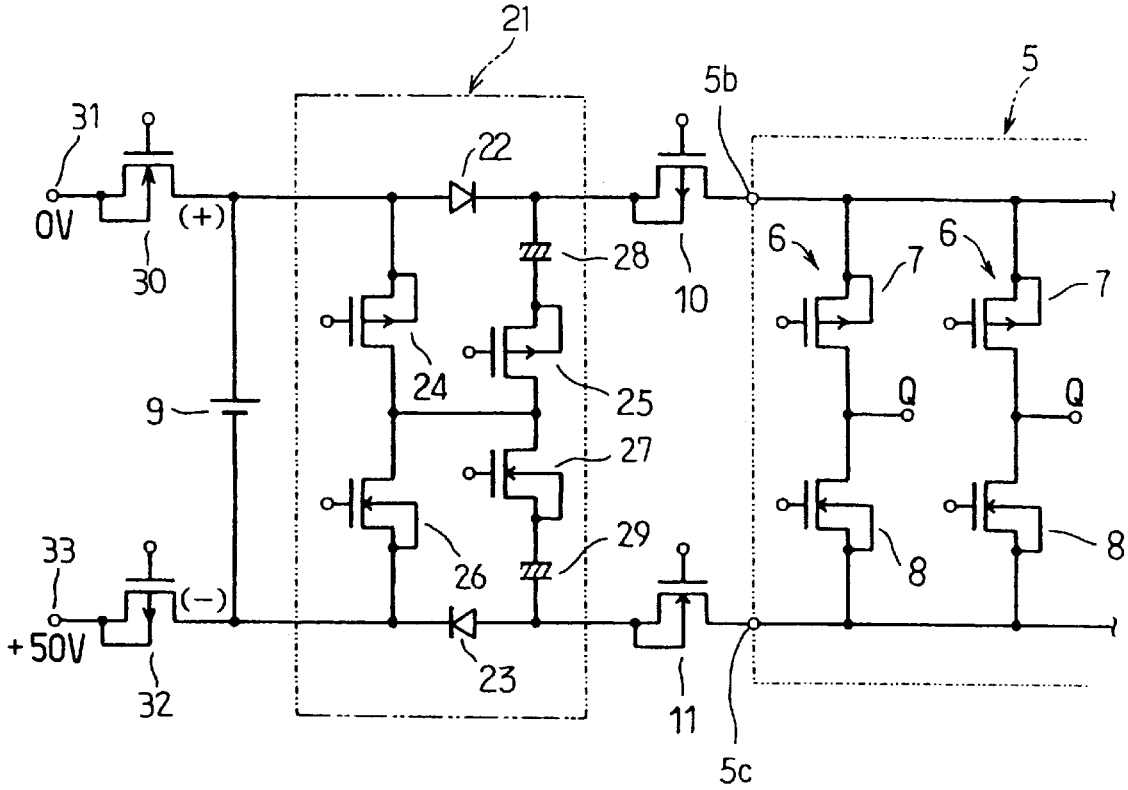
FIG. 6 is a circuit diagram showing a main portion of a driver circuit as a fourth embodiment of the present invention.

Now, referring to FIG. 6, the driver circuit of the fourth embodiment which includes a step-recycle circuit 21 will be described. The step-recycle circuit 21 is composed of: a first diode 22; a second diode 23; a P-channel MOSFET 24 (a first auxiliary switching element); a P-channel MOSFET 25 (a third auxiliary switching element); an N-channel MOSFET 26 (a second auxiliary switching element); an N-channel MOSFET 27 (a fourth auxiliary switching element); a first condenser 28; and a second condenser 29. More particularly, the first diode 22 is connected between the plus terminal of the power source 9 and the power MOSFET 10 in the forward direction. The second diode 23 is connected between the minus terminal of the power source 9 and the power MOSFET 11 in the forward direction. A series circuit consisting of the MOSFETs 24 and 26 is connected between the anode of the first diode 22 and the cathode of the second diode 23. A series circuit consisting of the first condenser 28, the MOSFETs 25, 27 and the second condenser 29 is connected between the cathode of the first diode 22 and the anode of the second diode 23. A junction of the MOSFETS 24 and 26 is connected to a junction of the MOSFETs 25 and 27.

The plus terminal of the power source 9 is connected to a base voltage terminal 31 having a voltage level of, e.g., 0 V through an N-channel MOSFET 30. The minus terminal of the power source 9 is connected to another base voltage terminal 33 having a voltage level of, e.g., 50 V through a P-channel MOSFET 32. The MOSFET 32 is turned on in the positive field, while the MOSFET 30 is to turned on in the negative field. The voltage of the power source 9 is set to 100 V in this particular embodiment. Accordingly, in the positive field, the voltage level of the minus terminal of the power source 9 is fixed to 50 V which is the base voltage, while the voltage level of the plus terminal of the power source 9 is shifted to 150 V. In the negative field, the plus terminal of the power source 9 is fixed to 0 V which is the base voltage, while the voltage level of the minus terminal of the power source 9 is shifted to −100 V.

Operation of the fourth embodiment will be described in reference to FIGS. 8A–10B. FIGS. 8A–8D and FIG. 10A show the operation in the positive field, while FIGS. 9A–9D and FIG. 10B show the operation in the negative field. All the transistors used in the circuit are shown as switches, and parasitic diodes associated with those transistors are also shown in the drawings.

Figures 8A, 8B, 8C, 8D:
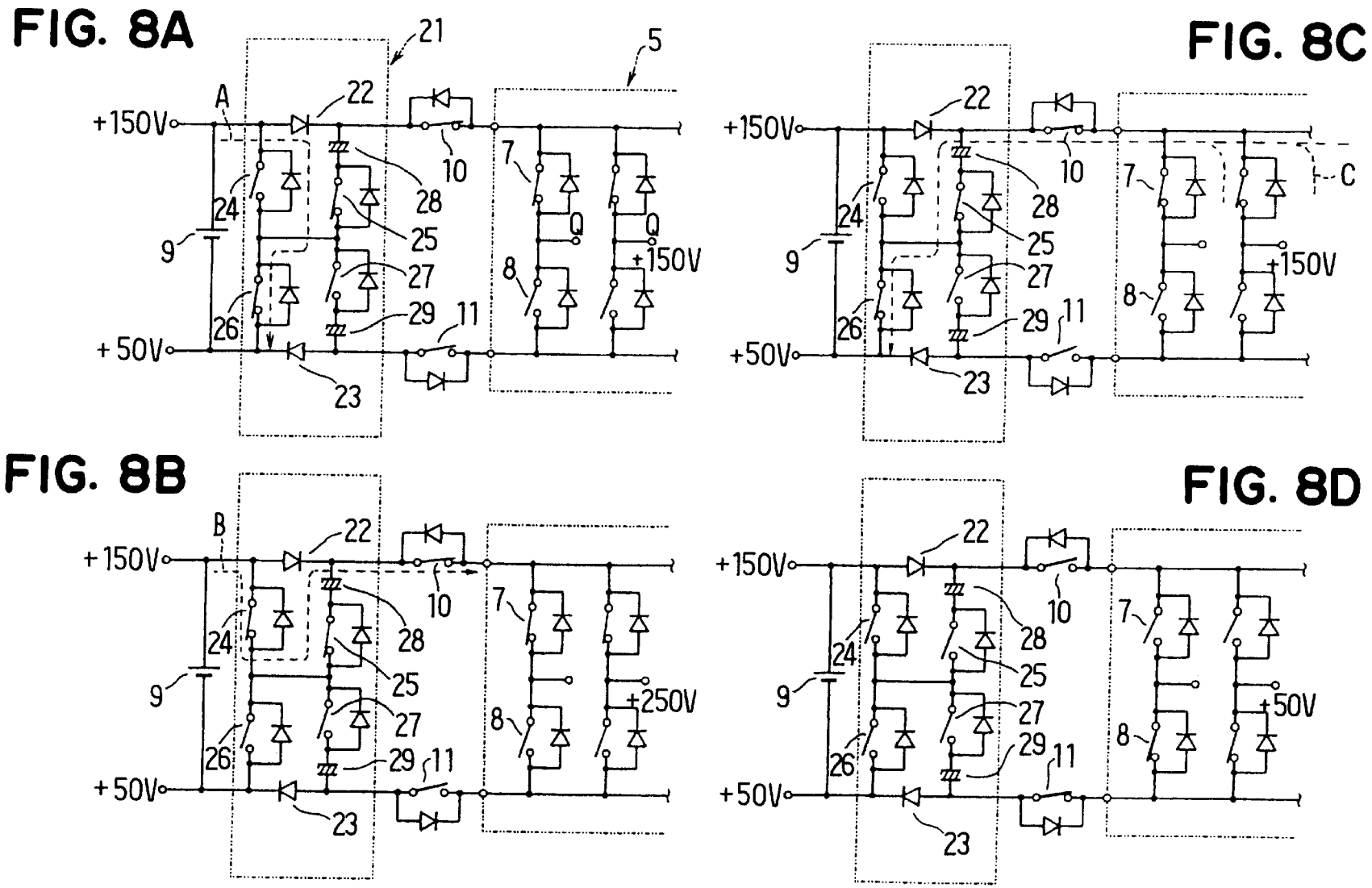
FIGS. 8A–8D are circuit diagrams showing operation of the fourth embodiment in a positive field.

Referring to FIGS. 8A–8D, the operation of the driver circuit in the positive field will be described. The plus terminal of the power source 9 is set at +150 V and the minus terminal is set at +50 V in the positive field, as described above. To supply charging voltage to the EL element 4, the power MOSFET 10 is turned on after the MOSFETs 25, 26 and the LDMOS 7 are turned on, as shown in FIG. 8A. At this stage, the first condenser 28 is charged through a circuit "A" (shown with a dotted line) that includes the plus terminal of the power source 9, the first diode 22, the first condenser 28 and the MOSFETs 25, 26. At the same time, the scanning voltage is supplied to the EL element 4 through a circuit composed of the plus terminal of the power source 9, the first diode 22, the power MOSFET 10, the LDMOS 7 and the scanning electrode 2. The level of the scanning voltage at this time is 150 V.

Then, the MOSFET 26 is turned off and the MOSFET 24 is turned on at the same time, thereby forming a circuit "B" shown with a dotted line in FIG. 8B. At this stage, the charges stored in the first condenser 28 are superimposed on the power source voltage (150 V), thereby raising the scanning voltage level to about 250 V. Accordingly, the EL element 4 is charged with this composite voltage of 250 V.

Then, the MOSFET 24 is turned off and the MOSFET 26 is turned on again at the same time, as shown in FIG. 8C, forming a circuit "C" shown with a dotted line. At this stage, the energy supplied to the EL element 4 is supplied to the first condenser 28 through the circuit "C" composed of a parasitic diode connected in parallel to the LDMOS 7 in the reverse direction, the power MOSFET 10, the first condenser 28 and MOSFETs 25, 26. Thus, a portion of the energy supplied to the EL element 4 is returned to the first condenser 28 to recycle that energy. At the same time, the scanning voltage becomes 150 V.

Then, the power MOSFET 10 is turned off and the power MOSFET 11 is turned on after the LDMOS 8 is turned on in place of the LDMOS 7 and the MOSFETs 25, 26 are turned off, as shown in FIG. 8D. At this stage, the charges stored in the first condenser 28 are maintained, and the scanning voltage becomes to an initial level of 50 V, because the scanning electrode 2 is connected to the minus terminal of the power source 9 through the LDMOS 8, the power MOSFET 11, the second diode 23.

Figure 10A:
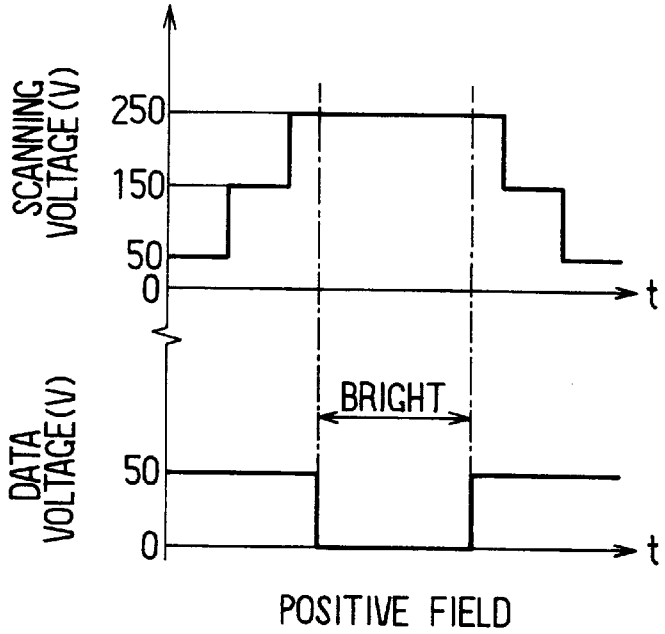
FIG. 10A is a graph showing scanning voltages and data voltages in a positive field of the fourth embodiment.

The operation in the positive field is summarized as shown in FIG. 10A. The scanning voltages supplied to the scanning electrode 2 change stepwise, i.e., 50 V→150 V→250 V→150 V→50 V. On the other hand, the data voltage having a 50 V level is supplied to the data electrode 3 during a non-luminance (dark) period, and the data voltage having a 0 V level is supplied during a luminance (bright) period. The EL element 4 emits light when 250 V (a difference between the scanning voltage and the data voltage) is imposed thereon.

Figures 9A, 9B, 9C, 9D:
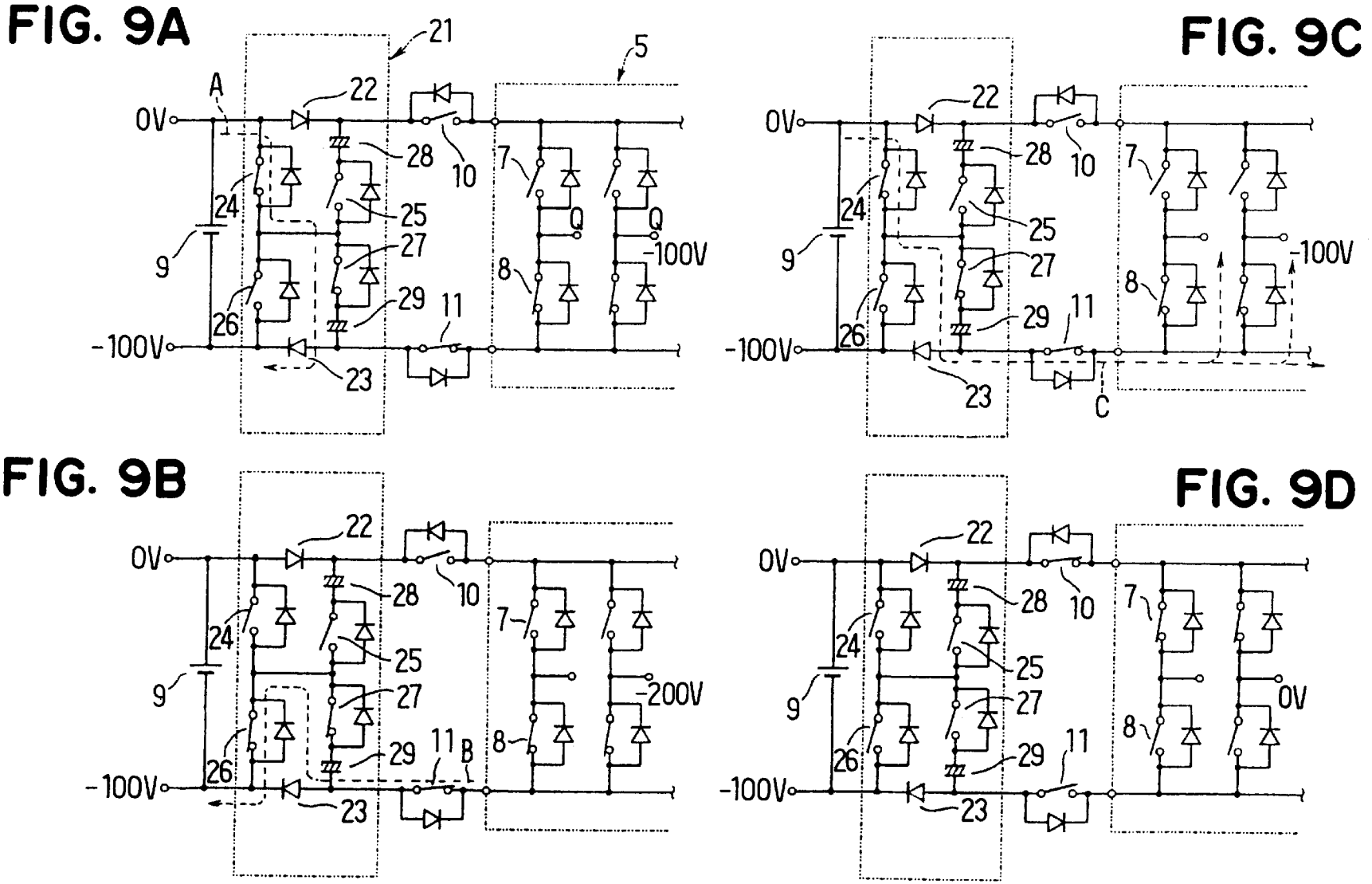
FIGS. 9A–9D are circuit diagrams showing operation of the fourth embodiment in a negative field.

Referring to FIGS. 9A–9D, the operation of the driver circuit in the negative field will be described. The plus terminal of the power source 9 is set at 0 V and the minus terminal is set at −150 V in the negative field, as described above. To supply charging voltage to the EL element 4, the power MOSFET 11 is turned on after the MOSFETs 24, 27 and the LDMOS 8 are turned on, as shown in FIG. 9A. At this stage, the second condenser 29 is charged through a circuit "A" (shown with a dotted line) that includes the plus terminal of the power source 9, the MOSFETs 24, 27, the second condenser 29 and the second diode 23. At the same time, the scanning voltage is supplied to the EL element 4 through a circuit composed of the minus terminal of the power source 9, the second diode 23, the power MOSFET 11, the LDMOS 8 and the scanning electrode 2. The level of the scanning voltage at this time is −100 V.

Then, the MOSFET 24 is turned off and the MOSFET 26 is turned on at the same time, thereby forming a circuit "B" shown with a dotted line in FIG. 9B. At this stage, the charges stored in the second condenser 29 are superimposed on the power source voltage (−100 V), thereby supplying the scanning voltage of about −200 V to the scanning electrode 2. Accordingly, the EL element 4 is charged with this composite voltage of −200 V.

Then, the MOSFET 26 is turned off and the MOSFET 24 is turned on again at the same time, as shown in FIG. 9C, forming a circuit "C" shown with a dotted line. At this stage, the energy supplied to the EL element 4 is supplied to the second condenser 29 through the circuit "C" composed of a parasitic diode connected in parallel to the LDMOS 8 in the reverse direction, the power MOSFET 11, the second condenser 29 and MOSFETs 24, 27. Thus, a portion of the energy supplied to the EL element 4 is returned to the second condenser 29 to recycle that energy. At the same time, the scanning voltage becomes −100 V.

Then, the power MOSFET 11 is turned off and the power MOSFET 10 is turned on after the LDMOS 7 is turned on in place of the LDMOS 8 and the MOSFETs 24, 27 are turned off, as shown in FIG. 9D. At this stage, the charges stored in the second condenser 29 are maintained, and the scanning voltage becomes to an initial level of 0 V, because the scanning electrode 2 is connected to the plus terminal of the power source 9 through the LDMOS 7, the power MOSFET 10, the first diode 22.

Figure 10B:
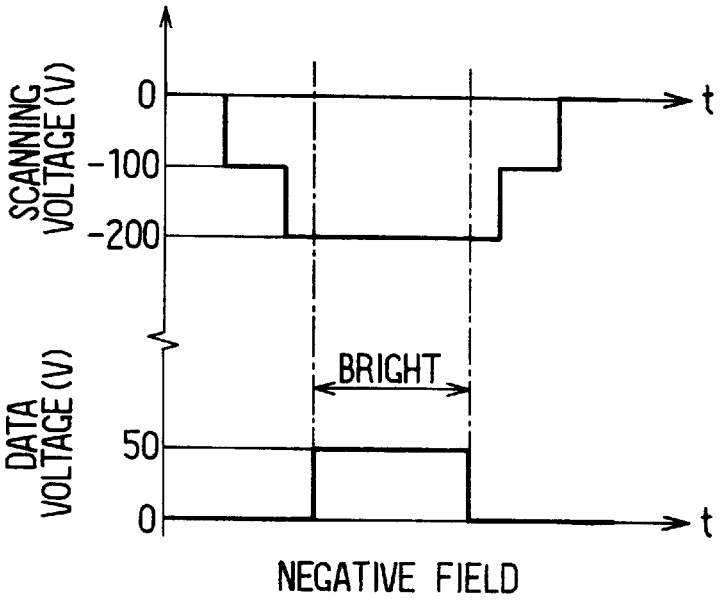
FIG. 10B is a graph showing scanning voltages and data voltages in a negative field of the fourth embodiment.
Figure 11:
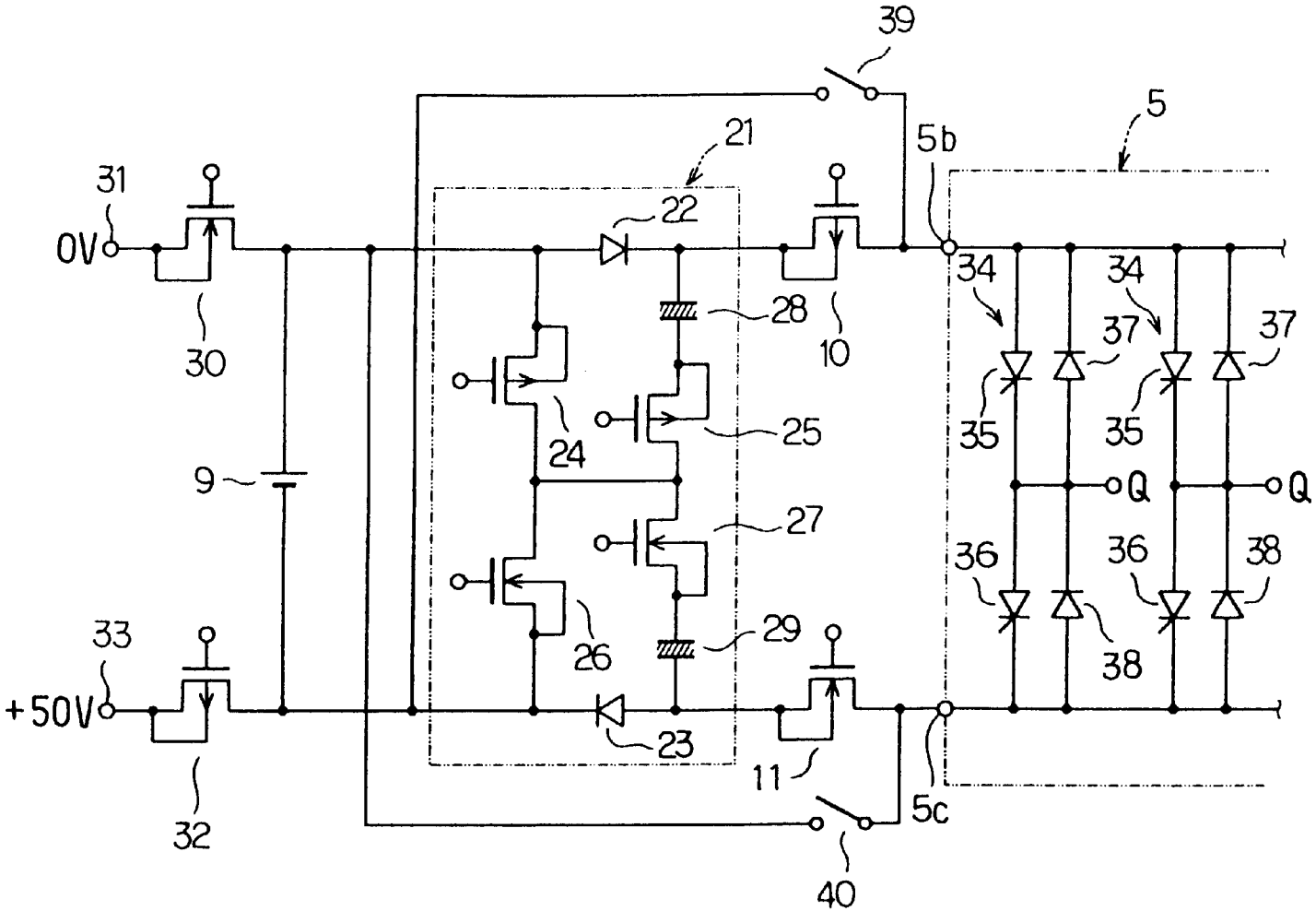
FIG. 11 is a circuit diagram showing a main portion of a driver circuit as a fifth embodiment of the present invention.

The operation in the negative field is summarized as shown in FIG. 10B. The scanning voltages supplied to the scanning electrode 2 change stepwise, i.e., 0 V→−100 V→−200 V→−100 V→0 V. On the other hand, the data voltage having a 0 V level is supplied to the data electrode 3 during a non-luminance (dark) period, and the data voltage having a 50 V level is supplied during a luminance (bright) period. The EL element 4 emits light when −250 V (a difference between the scanning voltage and the data voltage) is imposed thereon.

As described above, the voltage for charging the EL element 4 is stepwise changed, and thereby less power is consumed in the driver IC 5 and the temperature rise therein is suppressed. Since the switching loss occurs only in the power MOSFETs 10 and 11, the temperature rise is suppressed in the same manner as in the first embodiment. Moreover, since a portion of the energy supplied to the EL element is recycled to the condensers 28, 29 and is used again for charging the EL element, the power consumption is further reduced. Especially, when the display panel is driven alternately with positive and negative voltages as in the fourth embodiment, the first and the second condensers 28, 29 in the step-recycle circuit 21 are not unnecessarily discharged, and accordingly the charging energy is surely recycled. Moreover, since the output circuit 6 is composed of the push-pull circuit, it is suitable for driving the panel in alternating fields.

Referring to FIGS. 11–13D, a fifth embodiment of the present invention will be described. This embodiment is similar to the fourth embodiment. The output circuit 6 of the fourth embodiment is replaced with an output circuit 34 in which SCRs 35, 36 are used in place of the LDMOSs 7, 8. A first discharging diode 37 is connected in parallel to and in the reverse direction to the SCR 35, and a second discharging diode 38 is connected in parallel to and in the reverse direction to the SCR 36. An output terminal Q of the output circuit 34 is connected to a junction of both SCRs 35 and 36, and the output circuit 34 constitutes a push-pull circuit. A switching element 39 such as a MOSFET is connected between the minus terminal of the power source 9 and the first power supply terminal 5*b* of the driver IC 5. Similarly, a switching element 40 such as a MOSFET is connected between the plus terminal of the power source 9 and the second power supply terminal 5*c* of the driver IC 5. Other structures are the same as those of the fourth embodiment. FIGS. 12A–12D and 13A–13D are schematic circuit diagrams for explaining the operation of the fourth embodiment. In those circuit diagrams, all the transistors are shown as switches, parasitic diodes associated with the power MOSFETs 10, 11 are shown together with those MOSFETs, and the MOSFETs 30, 32 are not shown.

Referring to FIGS. 12A–12D, the operation in the positive field where the minus terminal of the power source 9 is fixed to 50 V will be described. To charge the EL element 4, the power MOSFET 10 is turned on after the MOSFETs 25, 26 and the SCR 35 are turned on, as shown in FIG. 12A. At this stage, the first condenser 28 is charged through a circuit "A" shown with a dotted line composed of the plus terminal of the power source 9, the first diode 22, the first condenser 28, and the MOSFETs 25, 26. The El element 4 is charged through a circuit composed of the plus terminal of the power source 9, the first diode 22, the power MOSFET 10, the SCR 35 and the scanning electrode 2. The scanning voltage at this stage is 150 V.

Then, the MOSFET 26 is turned off and the MOSFET 24 is turned on at the same time, as shown in FIG. 12B. At this stage, charges stored in the first condenser 28 are superimposed on the voltage (150 V) of the power source 9 through a circuit "B." The scanning voltage supplied to the EL element becomes to a level of 250 V. This means that the scanning voltage increases stepwise from 150 V to 250 V.

Then, the MOSFET 24 is turned off and the MOSFET 26 is turned on again, as shown in FIG. 12C. At this stage, energy of the EL element 4 is supplied to the first condenser 28 though a circuit "c" composed of the first discharging diode 37, the power MOSFET 10, the first condenser 28, and the MOSFETs 25, 26. A portion of the energy supplied to the EL element 4 is returned to the first condenser 28 to use it again. The scanning voltage becomes 150 V at this stage.

Then, the MOSFETs 25, 26 and the power MOSFET 10 are turned off and the switching element 39 is turned on at the same time, as shown in FIG. 12D. At this stage, the charges stored in the first condenser 28 are maintained, and the scanning voltage supplied to the EL element 4 is changed to an initial level. of 50 V through a circuit "ID" composed of the first discharging diode 37 and the switching element 39.

Figure 13A:
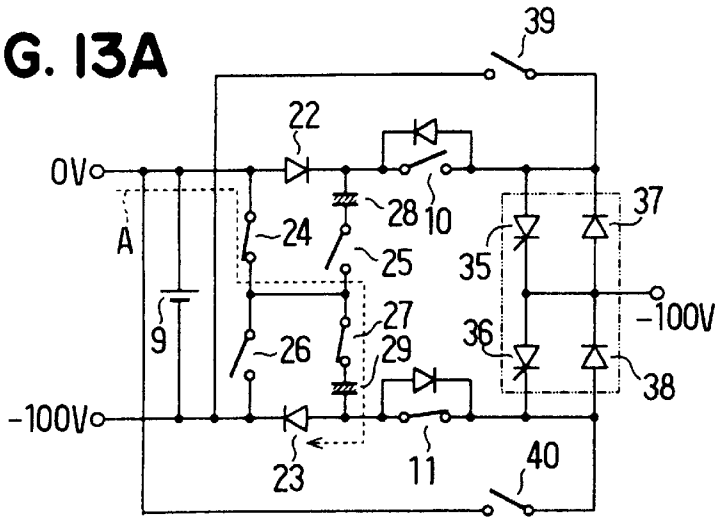
FIGS. 13A–13D are circuit diagrams showing operation of the fifth embodiment in a negative field.

Referring to FIGS. 13A–13D, the operation in the negative field where the plus terminal of the power source 9 is fixed to 0 V will be described. To charge the EL element 4, the power MOSFET 11 is turned on after the MOSFETs 24, 27 and the SCR 36 are turned on, as shown in FIG. 13A. At this stage, the second condenser 29 is charged through a circuit "A" shown with a dotted line composed of the plus terminal of the power source 9, the MOSFETs 24, 27, the second condenser 29 and the second diode 23. The EL element 4 is charged through a circuit composed of the minus terminal of the power source 9, the second diode 23, the power MOSFET 11, the SCR 36 and the scanning electrode 2. The scanning voltage at this stage is −100 V.

Figure 13B:
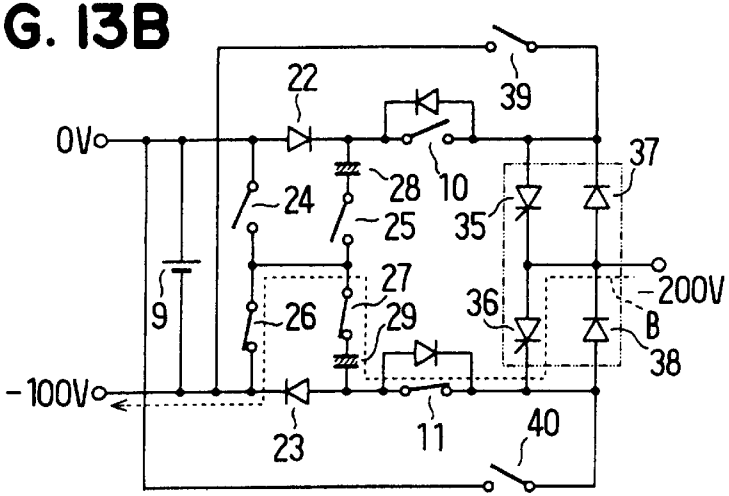

Then, the MOSFET 24 is turned off and the MOSFET 26 is turned on at the same time, as shown in FIG. 13B. At this stage, charges stored in the second condenser 29 are superimposed on the voltage (−100 V) of the power source 9 through a circuit "B." The scanning voltage supplied to the EL element becomes to a level of −200 V. This means that the scanning voltage changes stepwise from −100 V to −200 V.

Figure 13C:
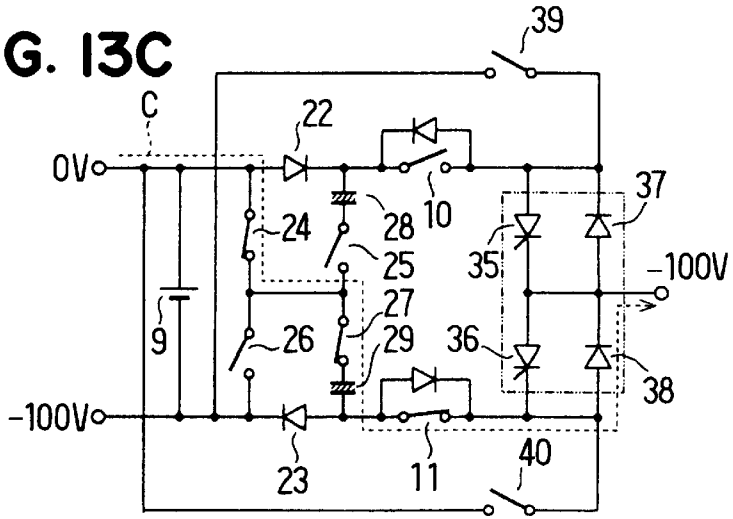

Then, the MOSFET 26 is turned off and the MOSFET 24 is turned on again, as shown in FIG. 13C. At this stage, energy of the EL element 4 is supplied to the second condenser 29 though a circuit "C" composed of the second discharging diode 38, the power. MOSFET 11, the second condenser 29, and the MOSFETs 24, 27. A portion of the energy supplied to the EL element 4 is returned to the second condenser 29 to use it again. The scanning voltage becomes −100 V at this stage.

Figure 13D:
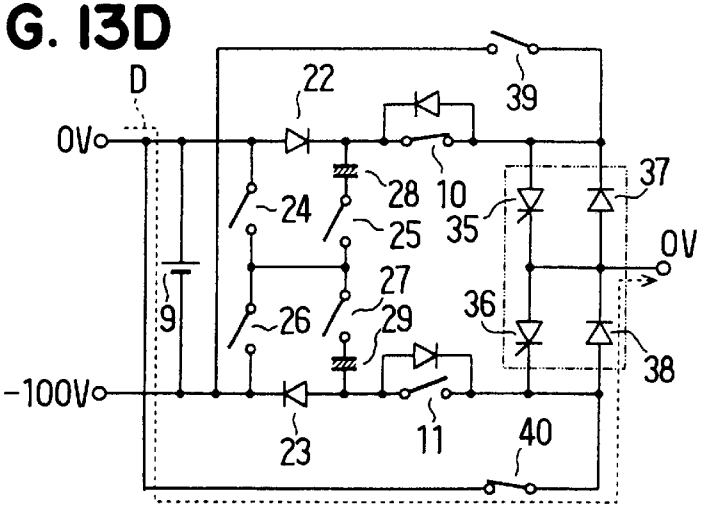

Then, the MOSFETs 24, 27 and the power MOSFET 11 are turned off and the switching element 40 is turned on at the same time, as shown in FIG. 13D. At this stage, the charges stored in the second condenser 29 are maintained, and the scanning voltage supplied to the EL element 4 is changed to an initial level of 0 V through a circuit "D" composed of the second discharging diode 38 and the switching element 40.

The same advantages as those of the fourth embodiment are obtained in the fifth embodiment, too. In addition, a large amount of current can be flown in the output circuit 34 of the fifth embodiment because the SCRs 35, 36 are elements which are latched-up to an on-condition. Therefore, in distributing power consumption to the driver IC 5 and the power MOSFETs 10, 11, a smaller portion of the power is allocated to the driver IC 5, and thereby the temperature rise in the driver IC 5 is further reduced. Further, the luminance of the EL elements can be increased because they are charged at a higher speed with a large amount of current. Moreover, since the first and second discharging diodes 37, 38 are connected in parallel to and in the reverse direction to the respective SCRs 35, 36, the disadvantage that the operation speed of the SCRs is slow is compensated by those discharging diodes 37, 38.

Though the power MOSFETs 10, 11 are used as the voltage dividing loads in the first, third, fourth and fifth embodiments, they may be replaced with other elements such as bipolar transistors or IGBTs. Though the EL display panel is driven by the driver circuit described above, other display panels having capacitive elements such as plasma display panels may be similarly driven by the driver circuit according to the present invention.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A driver circuit for driving capacitive display elements by charging and discharging the capacitive display elements with a voltage of a power source, the driver circuit comprising:

an integrated circuit connected to the capacitive display elements, the integrated circuit including a plurality of switching elements for charging and discharging the capacitive display elements; and voltage dividing loads constituted by transistors connected between the power source and the integrated circuit, so that a voltage supplied to the capacitive display elements is divided between the transistors and the integrated circuit, wherein:

the voltage supplied to the capacitive display elements is increased in a stepwise manner; and the transistors are turned off before the switching elements are turned on, and the transistors are turned on after the switching elements are turned on.

2. The driver circuit as in claim 1, wherein:

the switching elements in the integrated circuit are composed of plural pairs of switching elements; and each pair of the switching elements constitutes a push-pull circuit and is composed of a first switching element for charging the capacitive display element and a second switching element for discharging the same element.

3. The driver circuit as in claim 2, wherein:

the first switching element is a P-channel LDMOS, and the second switching element is an N-channel LDMOS.

4. The driver circuit as in claim 2, wherein:

the first and the second switching elements are SCRs.

5. The driver circuit as in claim 4, wherein:

a discharging diode is connected in parallel to and in a reverse direction to each SCR.

6. The driver circuit as in claim 2, the driver circuit further including:

a diode connected between the power source and the first switching element in a forward direction of the first switching element;

a condenser one terminal of which is connected to a cathode of the diode;

a first auxiliary switching element connected to the other terminal of the condenser, the first auxiliary switching element being turned on for a predetermined period including an initial period for charging the capacitive display element, thereby forming a circuit for charging the condenser from the power source through the diode, and the first auxiliary switching element forming another circuit for supplying energy charged in the capacitive display element to the condenser; and a second auxiliary switching element connected between the other terminal of the condenser and an anode of the diode, the second auxiliary switching element being turned on for a predetermined period after the first auxiliary switching element is turned off, thereby forming a circuit for superimposing charges stored in the condenser on voltage of the power source.

7. The driver circuit as in claim 2, the driver circuit further including:

a first diode connected between a plus terminal of the power source and the first switching element, so that an anode of the first diode is connected to the plus terminal of the power source;

a second diode connected between a minus terminal of the power source and the second switching element, so that a cathode of the second diode is connected to the minus terminal of the power source;

a first and a second auxiliary switching element connected in series between the anode of the first diode and the cathode of the second diode;

a first condenser and a third auxiliary switching element connected in series between the cathode of the first condenser and a junction of the first and second auxiliary switching elements; and a second condenser and a fourth auxiliary switching element connected in series between the anode of the second diode and a junction of the first and second auxiliary switching elements, wherein:

the capacitive display element is driven alternatively with a positive voltage and a negative voltage;

when the capacitive display element is driven with the positive voltage, a potential of the minus terminal of the power source is fixed to a first base voltage so that a potential of the plus terminal of the power source becomes a plus potential, the second and third auxiliary switching elements are turned on during a predetermined period including a period for supplying the positive voltage to the capacitive display element, thereby forming a circuit including the first diode through which the first condenser is charged with the power source voltage and another circuit through which the first condenser is charged with an charging energy of the capacitive display element, and then the second auxiliary switching element is turned off and the first auxiliary switching element is turned on at the same time, thereby superimposing charges stored in the first condenser on the power source voltage; and when the capacitive display element is driven with the negative voltage, a potential of the plus terminal of the power source is fixed to a second base voltage so that a potential of the minus terminal of the power source becomes a minus potential, the first and fourth auxiliary switching elements are turned on during a predetermined period including a period for supplying the negative voltage to the capacitive display element, thereby forming a circuit including the first and fourth auxiliary switching elements through which the second condenser is charged with the power source voltage, and then the first auxiliary switching element is turned off and the second auxiliary switching element is turned on at the same time, thereby superimposing charges stored in the second condenser on the power source voltage.

8. The driver circuit as in claim 7, wherein:

when the display element is driven with the positive voltage, the first auxiliary switching element is turned off and the second auxiliary switching element is turned on at the same time after the charges stored in the first condenser is superimposed on the power source voltage, thereby forming a circuit for supplying energy charged in the capacitive display element to the first condenser as a charging current.

9. The driver circuit as in claim 7, wherein:

when the display element is driven with the negative voltage, the second auxiliary switching element is turned off and the first auxiliary switching element is turned on at the same time after the charges stored in the second condenser is superimposed on the power source voltage, thereby forming a circuit for supplying energy charged in the capacitive display element to the second condenser as a charging current.

10. The driver circuit of claim 1, wherein the transistors are turned on after the switching elements are turned on so that switching losses occur at the transistors.

11. The driver circuit of claim 1, wherein the transistors are turned on after the switching elements are turned on to suppress an increase in temperature in the integrated circuit.

12. The driver circuit of claim 1, wherein the transistors are turned on after the switching elements are turned on so that switching losses occur at the transistors to thereby suppress an increase in temperature in the integrated circuit.

* * * * *